United States Patent [19]

Yoshida et al.

[11] Patent Number: 4,509,319

[45] Date of Patent: Apr. 9, 1985

[54] WIRE ROPE

[75] Inventors: Tatsuo Yoshida; Kikuo Fukuda, both of Kakogawa; Akihiko Tomiguchi, Nabari, all of Japan

[73] Assignee: Shinko Kosen Kogyo Kabushiki Kaisha, Amagasaki, Japan

[21] Appl. No.: 641,931

[22] Filed: Aug. 20, 1984

Related U.S. Application Data

[63] Continuation of Ser. No. 324,664, Nov. 24, 1981, abandoned.

[30] Foreign Application Priority Data

Dec. 27, 1980 [JP] Japan ..... 55-188642

[51] Int. Cl.[3] ..... D07B 1/14; D07B 1/08; D07B 5/00

[52] U.S. Cl. ..... 57/218; 57/213; 57/215; 57/219

[58] Field of Search ..... 57/211-223; 174/108

[56] References Cited

U.S. PATENT DOCUMENTS

| | | | |
|---|---|---|---|
| 1,055,326 | 3/1913 | Gore | 57/220 |
| 1,405,837 | 2/1922 | Green | 57/219 X |
| 1,405,838 | 2/1922 | Green | 57/220 |
| 1,481,801 | 1/1924 | Harrison | 57/214 |
| 1,811,697 | 6/1931 | Reilly | 57/214 |
| 2,212,700 | 8/1940 | Peterson et al. | 174/108 |
| 2,241,955 | 5/1941 | Noyer et al. | 57/214 |
| 2,276,042 | 3/1942 | Jacobson | 57/222 |
| 2,584,027 | 1/1952 | Kendrick | 174/108 |
| 3,018,606 | 1/1962 | Dietz | 57/214 |
| 3,018,607 | 1/1962 | Dietz et al. | 57/214 |
| 3,352,098 | 11/1967 | Gilmore | 57/214 |
| 4,244,172 | 1/1981 | Glushko et al. | 57/215 |

*Primary Examiner*—John Petrakes

*Attorney, Agent, or Firm*—Oblon, Fisher, Spivak, McClelland & Maier

[57] ABSTRACT

A wire rope which includes a filler material disposed in the interstices between a core rope and respective outer strands and/or in the gaps between individual outer strands wherein the filler element is placed independently in the respective interstices and gaps or an interstice and an outwardly contiguous strand gap as an independent unit. A reinforcing core is anchored in the filler element at least in the interstices between the core rope and the respective outer strands.

2 Claims, 13 Drawing Figures

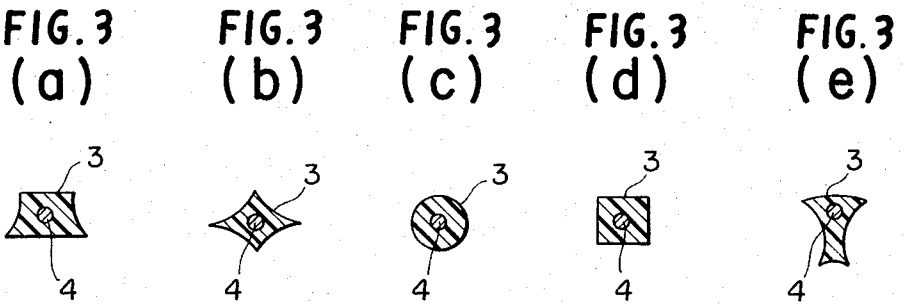
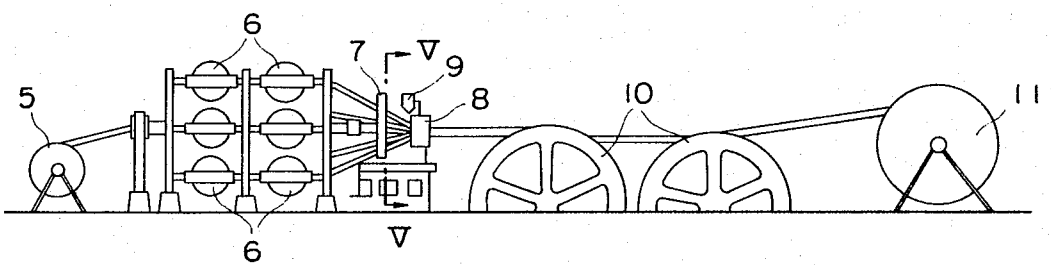
FIG. 4

WIRE ROPE

This application is a continuation of application Ser. No. 324,664, filed Nov. 24, 1981, now abandoned.

BACKGROUND OF THE INVENTION

1. Field of the Invention

This invention relates to a filler-laid wire rope.

2. Description of the Prior Art

In the fabrication of a wire core rope, it is known in the art to fill the gaps between the individual outer strands with a filler material like a thermoplastic resin or to impregnate a filler material into all the gaps and interstices including the gaps between the core rope and the outer strands as disclosed in U.S. Pat. No. 3,824,777. Such impregnated wire ropes possess excellent properties in abrasive resistance, fatigue strength and loss of wire rope breaking load by stranding and closing, due to the effects of suppressing abrasive contact of the individual outer strands or of the outer strands with the core rope and entrapping the lubricant oil impregnated into the core rope and strands. However, the conventional impregnated wire rope which has the filler material integrally positioned around its entire outer periphery has an inherent drawback in that the flexibility of the wire rope as a whole is impaired to a considerable degree. Further, the filler material is susceptible to cracking and peeling especially when the rope is used as a running rope.

SUMMARY OF THE INVENTION

Therefore, the present invention has as its object the provision for a wire rope which does not invite deterioration in flexibility and prevents cracking and peeling of the filler material, while retaining the fundamental effects with regard to the higher abrasive resistance and fatigue strength and reduction of loss of wire rope breaking load by stranding and closing.

One feature of the wire rope according to the present invention resides in the fact that, in filling a filler material in the interstices between the core rope and the respective outer strands and/or in the gaps between the individual outer strands, a filler element is placed independently in the respective interstices and gaps or an interstice and an outwardly contiguous strand gap are treated as an independent unit.

Another feature of the invention resides in the fact that a reinforcing core is anchored in the filler element at least in the interstices between the core rope and the respective outer strands.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein:

FIG. 3 is a schematic view showing filler elements of different sectional shapes;

FIG. 4 shows an apparatus for producing the wire rope of the present invention;

DETAILED DESCRIPTION OF THE PREFERRED EMBODIMENTS

First of all, it is to be understood that the present invention is applicable to wire ropes in general irrespective of the wire rope core, strand core and fibre core. By way of example, the following description shows a wire rope with a wire rope core, more specifically, IWRC 6×Fi(25) JIS Type 14.

Figure 1:
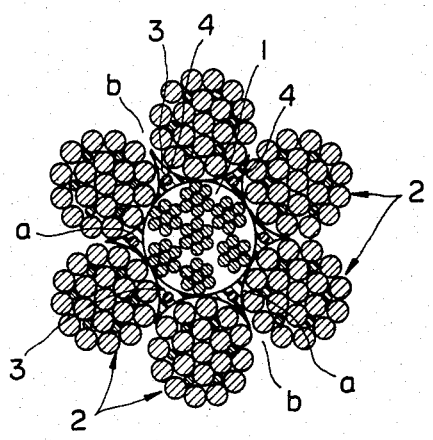
FIG. 1 is an enlarged sectional view of a wire rope in accordance with a first embodiment in the present invention.
Figure 2:
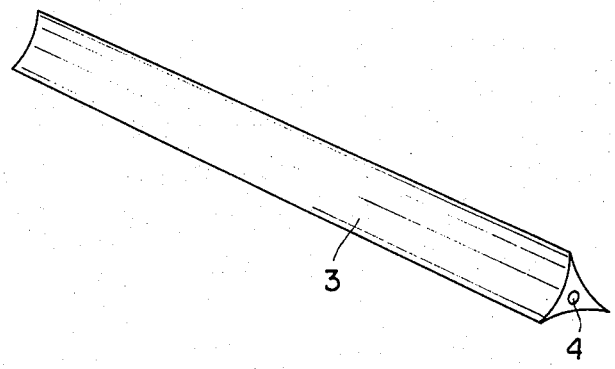
FIG. 2 is a fragmentary perspective view of a filler element.

Referring to FIG. 1, designated by reference number 1 is a core rope, by 2 six outer strands arranged around the outer periphery of core rope 1, and by 3 a filler element which fills independently each one of the interstices a which are formed between core rope 1 and outer strands 2. Filler element 3 of a thermoplastic resin or the like is formed into a cord-like shape substantially of triangular cross-section in conformity with the interstice a, as shown in FIG. 2, and laid together with core rope 1 and outer strands 2 at the time of closing the rope to fill the respective interstices a independently of each other like outer strands 2. In this instance, filler elements 3 are preferably formed slightly larger than the cross-section of the interstices a. By so doing, filler elements 3 are securely contacted with core rope 1 and outer strands 2 by the closing pressure, enhancing the effects of the filler elements all the more, namely, the effect of separating core rope 1 and outer strands 2 from each other and the effect of sealing the lubricant oil (not shown) which is impregnated between core rope 1 and outer strands 2.

The outer strands of the wire rope are arranged to have a percentage of voids in the range of 2.0–6.0%. The grounds for this definition of the value of the percentage of voids h are shown below.

Percentage of voids $h$ (%) =

$$\frac{\text{circumference of pitch circle of wire rope } (= 2\pi r) - \text{sum of arc } AB\ (= 6\,AB)}{2\pi r} \times 100$$

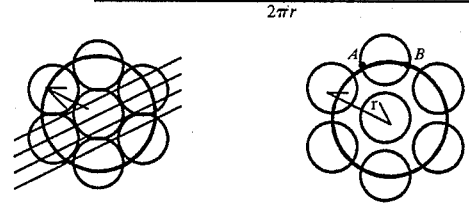

When a wire rope which has a percentage of voids greater than about 2% is bent on a sheave, it is possible to avoid contacts of the strands on the inner side (compression side) of the bend. This is the reason why the minimum value of the percentage of voids h is set at 2.0%. On the other hand, if the percentage of voids h exceeds 6.0%, the core rope is exposed to an external view, lowering the commercial value of the wire rope.

In addition, a percentage of voids greater than 6% invariably requires reduction in the diameter of the outer strands, making it difficult to guarantee the standard breaking load. Thus, the maximum value of the percentage of voids h is 6.0%. Accordingly, in the present invention, the filler elements 3 are laid with a precondition that the percentage of voids h is 2.0 to 6.0%.

It is preferred to anchor a reinforcing core 4 of a wire of hemp centrally in respective filler elements 3. Reinforcing core 4 contributes to strengthen filler elements 3 and to prevent its cracking or peeling especially when in service as a running rope, while improving the breaking characteristics of the wire rope as a whole. Further, it also has an effect of preventing the filler element from rupturing, falling or twisting during the closing operation.

In addition to the shapes shown in FIGS. 1 and 2, it is possible to form filler elements 3 in various other shapes as shown in FIG. 3. According to the present invention, such is formed into a suitable shape which conforms to the interstice a.

Figure 5:
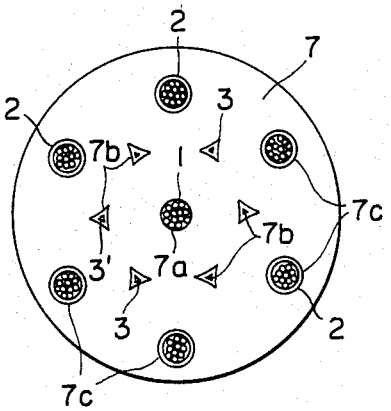
FIG. 5 is an enlarged sectional view taken along line V—V of FIG. 4.

The above-described filler-laid wire rope is fabricated by the method and apparatus as follows. Referring to FIGS. 4 and 5, indicated by reference number 5 is a feeder for core rope 1, by 6 bobbins for the outer strands 2 and filler elements 3, by 7 a guide plate, by 8 a closing die, by 9 an oil feed tank, by 10 capstans and by 11 a take-up reel. Guide plate 7 is provided with a core rope passing hole *7a* at the center thereof, filling passing holes *7b* formed in positions radially outward of the core rope passing hole *7a*, and outer strand passing holes *7c* formed in positions radially outward of filler passing holes *7b*. Filler passing holes *7b* are preferably formed substantially in the same shape as filler element 3 to guide the latter in a correct posture. Core rope 1 and filler elements 3 which are supplied from feeder 5 and bobbins 6 are passed through respective holes *7a* and *7b* of guide plate 7 and thereby held in predetermined positional relationship before being intertwisted by closing die 8. The filler-laid wire rope of FIG. 1 is thus produced and taken up on reel 11. Thus, the wire rope of the invention can be produced easily fundamentally by the conventional wire rope fabricating method and apparatus, maintaining core rope 1, outer strands 2 and filler elements 3 in predetermined positional relationship by guide plate 7.

With the wire rope of the invention, it is possible to lesson considerably the contact pressure as caused between core rope 1 and the respective outer strands 2 by a dynamic load especially during service as a running rope, thereby reducing abrasion and fatigue of core rope 1 and outer strands 2 as well as the loss of wire rope breaking load by stranding and closing. Further, filler elements 3 seal in and prevent exudation of the lubricant oil which is impregnated into core rope 1 and outer strands 2. Consequently, the abrasive resistance and fatigue strength of the wire rope as a whole are improved while reducing the loss of wire rope breaking load by stranding and closing. Furthermore, the entrapped lubricant oil lessens the necessity for relubrication when the wire rope is in service and has the effect of preventing internal corrosion over a long period of time.

In addition to the above-mentioned fundamental effects, filler element 3 has another advantages in that no possibility exists of impairing the flexibility of the wire rope as a whole since the filler element is laid independently and thus structurally separately in the respective interstice a. Besides, as mentioned hereinbefore, reinforcing core 4 protects the filler element against damage, i.e., rupturing or peeling, to ensure the above-mentioned effects of the filler elements for a relatively long period of time.

Figure 8:
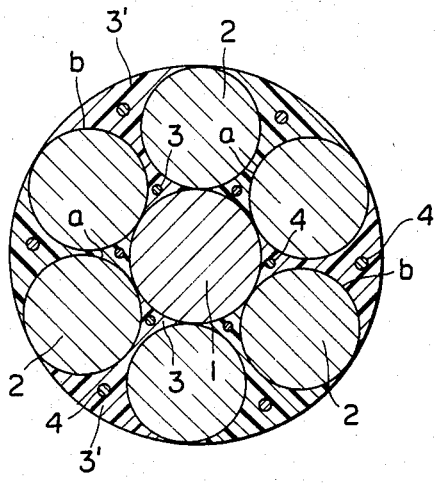
FIG. 8 is an enlarged sectional view showing a third embodiment of the present invention.
Figure 9:
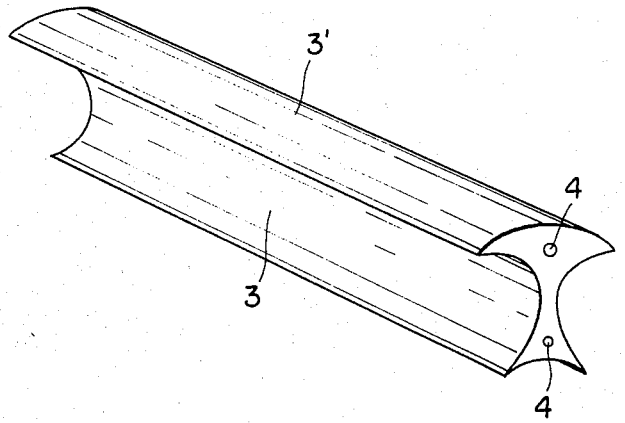
FIG. 9 is a fragmentary perspective view of the filler elements used in the third embodiment.

Illustrated in FIGS. 6–9 are second and third embodiments of the wire rope according to the present invention. In the wire rope of FIG. 6, in addition to the filler elements 3 which are laid in the interstices a between core rope 1 and outer strands 2 in the same manner as in the foregoing embodiment, filler elements 3' of a shape fitting to the outer strand gaps b (filler elements 3 and 3' are hereinafter referred to as "inner filler element" and "outer filler element", respectively) are laid independently in the outer strand gaps b. In the wire rope construction of FIG. 8, inner and outer filler elements 3 and 3' which are formed into an integral body as shown particularly in FIG. 9 are laid in each interstice a and an outwardly contiguous outer strand gap b, treating the interstice a and the contiguous gap b as an independent unit.

Figure 6:
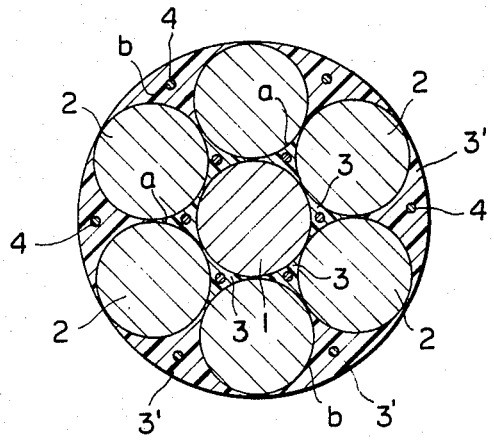
FIG. 6 is an enlarged view showing a wire rope construction in accordance with a second embodiment.
Figure 7:
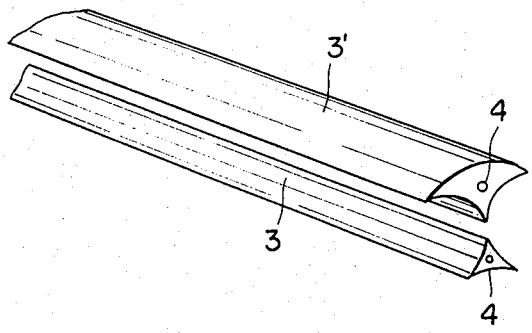
FIG. 7 is a fragmentary perspective view of the filler elements used in the second embodiment.

The wire ropes shown in FIGS. 6 and 8 lessens not only the contact pressure between core rope 1 and outer strands 2 but also the contact pressure between the individual outer strands 2, improving the wire rope as a whole in abrasive resistance, fatique strength and loss of wire rope breaking load by stranding and closing. Particularly, these effects are manifested more pronouncedly in the wire rope construction of FIG. 8 in which the outer strands 2 are completely separated by the bridge portions of the inner and outer filler elements 3 and 3'. These wire ropes also give excellent results in the effect of entrapping the lubricant oil.

The wire rope construction of FIG. 6 provides substantially the same effect as in the embodiment of FIG. 8 if inner and outer filler elements 3 and 3' are arranged to contact with each other in the radial direction. In the wire rope constructions of FIG. 6 and 8, the effect of entrapping the lubricant oil is augmented by contacting the adjacent outer filler elements 3' with each other through circumferentially extending film portions in such a manner that the outer peripheries of outer strands 2 are covered by the contacting film portions. On the other hand, although the reinforcing cores 4 are anchored in both the inner and outer filler elements in these wire rope constructions, they may be embedded basically only in inner filler elements 3 except for a special application or a case where increased effects of the filler elements are desired.

The foregoing wire ropes are also fabricated by laying the filler elements concurrently with the outer strands at the time of closing in the same manner as in the wire rope construction of FIG. 1. Needless to say, the resulting wire ropes also have the effects unique to the present invention, namely, retaining flexibility and preventing cracking or peeling of the filler elements, similarly to the wire rope construction of FIG. 1.

In the above-described concurrent filler-laying method which has been employed for the fabrication of the wire rope of the invention, the filler elements are laid in simultaneously with the closing operation so that there is no need for providing a separate filler-laying stage in the fabrication process, thus ensuring high production efficiency of the rope. The method also has advantages over the conventional coating method since it does not require the preheating treatment of the rope prior to impregnation of the filler material nor equipment like an extruder. The low equipment cost, coupled with the high productivity of the rope, permits realization of a material cost reduction of the wire rope. In view of these points, the simultaneous filler-laying method is considered to be the most advantageous and suitable method for the fabrication of the wire rope of the present invention and thus to be the sole method which is conceivable for actual application. However, any other method may be employed as long as the filler elements can be laid in the same manner.

The following experiments more particularly illustrate the fatigue strength and other properties of the wire rope according to the present invention.

EXPERIMENT 1

The following wire rope specimens of IWRC 6×Fi(25) 16 mm JIS Type 14 were subjected to a repeated bending test.

(i) A black wire rope;

(ii) A wire rope construction of FIG. 1 according to the invention; and (iii) A conventional wire rope having interstices and gaps completely and integrally impregnated and filled with a thermoplastic resin.

In the test, a pair of testing sheaves were positioned between a drive sheave and a tension sheave, and specimens (i) to (iii) were passed in S-shape through the testing sheaves, fixing their opposite ends to the drive and tension sheaves through auxiliary ropes. A horizontal tensile load was applied to the tension sheave during repeated bending tests under the following conditions.

Rope diameter d (mm): 16
Testing sheave pitch diameter
D (mm): 256
D/d ratio: 16
Testing load (kg): 1190
Nominal breaking load of test
wire rope (kg): 11900
Safety factor: 10
Sheave arrangement: S-shape The test results are shown in Table 1.

TABLE 1

| Specimens | Number of repeated bendings (times) | |
|---|---|---|
| | Initial wire breaking | 10% wire breaking (terminal point of test) |
| (i) | 8500 | 17000 |
| (ii) | 12500 | 26500 |
| (iii) | 13000 | 27500 |

EXPERIMENT 2

The following wire rope specimens of IWRC 6×Fi(29) 44 mm were tested for flexibility, increase in diameter and loss of wire rope breaking load by stranding and closing. The test results are shown in Table 2.

(i) A black wire rope;

(ii) A wire rope construction of FIG. 1 according to the invention; and (iii) A conventional wire rope having interstices and gaps completely and integrally impregnated and filled with a thermoplastic resin.

TABLE 2

| Specimens | Flexibility % | Rope diameter | | Loss of breaking load % |
|---|---|---|---|---|
| | | Diameter mm | Increment % | |
| (i) | 100 | 44.80 | 0 | 18.1~23.1 |
| (ii) | 95f100 | 45.46~45.58 | +1.47~+1.74 | 14.1~18.1 |

TABLE 2-continued

| Specimens | Flexibility % | Rope diameter | | Loss of breaking load % |
|---|---|---|---|---|
| | | Diameter mm | Increment % | |
| (iii) | 70f75 | 46.26~46.38 | +3.26~+3.53 | 14.5~19.0 |

The flexibility is expressed by an index number based on 100% of the black rope (speciman (i)), and the loss of wire breaking load by stranding and closing is expressed by:

$$\text{Loss of breaking load (\%)} = \left(1 - \frac{\text{actual breaking load of wire rope}}{\text{aggregate breaking load of individual wires}}\right) \times 100$$

The results of Experiments 1 and 2 show that the wire rope of the present invention is almost comparable to the completely impregnated wire rope with regard to the repeated bending strength in spite of the fact that the tested specimen was of the construction of FIG. 1 with the filler elements laid only in the inner interstices, and excels the latter in the flexibility and loss of wire rope breaking load as well as the increment in diameter.

It will be appreciated from the foregoing description that the wire rope of the present invention retains the improved properties of the impregnated wire rope in abrasive resistance, fatigue strength and loss of wire rope breaking load by stranding and closing, without impairing the flexibility of the wire rope, while preventing cracking and peeling of the filler material, and thus has an extremely high practical use characteristic.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A wire rope comprising:

a core rope;

a plurality of outer strands, including outermost strands, laid on the circumference of said core rope, said outermost strands having gaps formed therebetween and forming a plurality of first interstices between said core rope and said respective outermost strands and a plurality of second interstices formed between said outermost strands at positions radially outside of said gaps;

means for maintaining flexibility of said rope without cracking and peeling, said means for maintaining comprising a flexible filler element of a thermoplastic material formed as an integral body independently disposed in each of said first interstices formed between said core rope and said outermost strands, and in each of said gaps and second interstices between the individual outer strands, each said filler element being preformed with a shape corresponding to that of an interstice in which said filler element is disposed; and a reinforcing core embedded in at least said filler element disposed in a respective one of said first and second interstices.

2. A wire rope comprising:

a core rope;

a plurality of outer strands, including outermost strands, laid on the circumference of said core rope, said outermost strands having radially outwardly extending continguous gaps formed therebetween and forming a plurality of first interstices between said core rope and said respective outermost strands and a plurality of second interstices formed between said outermost strands at positions radially outside of said gaps; and means for maintaining flexibility of said rope without cracking and peeling, said means for maintaining comprising a filler element of a thermoplastic material formed as an integral body disposed in the first interstices formed between said core rope and the respective outermost strands, in the radially outwardly extending contiguous gaps between the individual outermost strands and in said second interstices, wherein corresponding ones of said first and second interstices and a radially outwardly extending contiguous gap together comprise a single independent unit, each said filler element being preformed with a shape corresponding to that of an independent unit in which said filler element is disposed, wherein said filler element further comprises a reinforcing core embedded therein at least in a portion located within a respective one of said first and second interstices.

* * * * *

UNITED STATES PATENT AND TRADEMARK OFFICE

CERTIFICATE OF CORRECTION

PATENT NO. : 4,509,319

DATED : April 9, 1985

INVENTOR(S) : Yoshida et al

It is certified that error appears in the above-identified patent and that said Letters Patent is hereby corrected as shown below:

On the title page;

The priority information is incorrect:

--[30] JAPAN 55-188641 12/27/80 --

Signed and Sealed this

Tenth Day of September 1985

[SEAL]

*Attest:*

DONALD J. QUIGG

*Attesting Officer* *Acting Commissioner of Patents and Trademarks - Designate*